US006058659A

United States Patent [19]

Astrom

[11] Patent Number: 6,058,659

[45] Date of Patent: May 9, 2000

[54] SANITARY FLOOR

[76] Inventor: Dan Astrom, Stora Svängen 8, S-691 44 Karlskoga, Sweden

[21] Appl. No.: 09/101,152

[22] PCT Filed: Jan. 4, 1996

[86] PCT No.: PCT/SE96/00004

§ 371 Date: Oct. 8, 1998

§ 102(e) Date: Oct. 8, 1998

[87] PCT Pub. No.: WO97/25493

PCT Pub. Date: Jul. 17, 1997

[51] Int. Cl.[7] ..... A47K 3/16

[52] U.S. Cl. ..... 52/34; 52/35; 52/302.1; 52/589.1; 52/592.1; 4/251.1; 4/612; 4/614

[58] Field of Search ..... 52/34, 35, 589.1, 52/592.1, 302.1, 389; 4/612–614, 251.2, 584, 251.1

[56] References Cited

U.S. PATENT DOCUMENTS

| | | | |
|---|---|---|---|
| 1,017,167 | 2/1912 | Pleins . | |
| 3,457,568 | 7/1969 | Amatruda . | |
| 3,675,384 | 7/1972 | Knecht . | |
| 4,307,814 | 12/1981 | Ihira . | |
| 4,541,132 | 9/1985 | Long | 4/614 |
| 4,557,004 | 12/1985 | Piana | 4/613 |
| 5,140,789 | 8/1992 | De Gooyer | 52/71 |
| 5,371,980 | 12/1994 | Dix | 52/34 |
| 5,845,347 | 12/1998 | Young | 4/613 |

FOREIGN PATENT DOCUMENTS

| | | |
|---|---|---|
| 3134370 | 9/1982 | Germany . |
| 3637585 | 5/1987 | Germany . |
| 3440545 | 1/1993 | Germany . |

*Primary Examiner*—Carl D. Friedman
*Assistant Examiner*—Yvonne M. Horton
*Attorney, Agent, or Firm*—Ostrolenk, Faber, Gerb & Soffen, LLP

[57] ABSTRACT

An arrangement for a sanitary floor in bathrooms, laundries or the like where the floor comprises at least one fall inclined toward at least one floor drain. The upper layer of the floor comprises at least two separate, adjacent, rectangularly formed block elements. At least one of the block elements includes the floor drain. Each block element has a lower surface which is parallel with a bedding that supports the block elements. Each block element also has an upper surface which inclines or is inclined a predetermined angle towards the floor drain.

14 Claims, 1 Drawing Sheet

SANITARY FLOOR

BACKGROUND OF THE INVENTION

The present invention relates to an arrangement for a sanitary floor such as a floor in a bathroom, a laundry or the like, said floor includes at least one fall of the same towards at least one floor drain.

Today a big problem is to provide sanitary floors having adequate and correct fall to a floor drain provided therein. The most common method is to cast the floor or fill up the same with concrete so that a fall is formed in a direction towards the floor drain. It has been found to be very difficult, especially after construction, for example to create said top casting or filling so that the outflow towards the floor drain functions satisfactory without having water remaining in pools in different locations on the floor surface. During new construction often uses prefabricated wiping rails inclinded towards the floor drain, which are later removed. After that a first casting is carried out and whereafter the marks after the rails have been filled up by concrete. This has been found to be very expensive and time consuming.

SUMMARY OF THE INVENTION

The object with the present invention is to provide an arrangement for a sanitary floor of the type mentioned above by aid of which the drawbacks stated above have been eliminated. The distinguishing features according to the invention are stated in the claims enclosed.

The invention makes it possible in a very easy way to provide a sanitary floor having a fall towards a floor drain which means that problems concerning a correct outflow no longer exist. The floor can be mounted on an already existing even supporting surface and a method using castings in different stages is no longer implemented. After mounting the block elements forming the sanitary floor the floor is finished to serve as a support for a sanitary carpet of plastic material or a suitable type of clinker or tile floor. A special treatment of the block elements is not necessary after mounting the same since each respective block element is prefabricated. The block elements often only need to be cut off along the edges which are turned towards the outer walls of the room in question. In the case of large floor surfaces, the outermost elements only have to be raised to a level which is the same as adjacent elements by aid of special spacers. In the cases the different block elements forming the floor in their edge sections are provided with groove and tenon, it is guaranteed that a correct passage in the same level can be provided without a filling up casting afterwards. This is an advantage in the event that the floor is later covered by a plastic carpet.

BRIEF DESCRIPTION OF THE DRAWINGS

The invention shall be described closer below with reference to the drawing enclosed, in which.

DETAILED DESCRIPTION OF THE DRAWINGS

Figure 1:
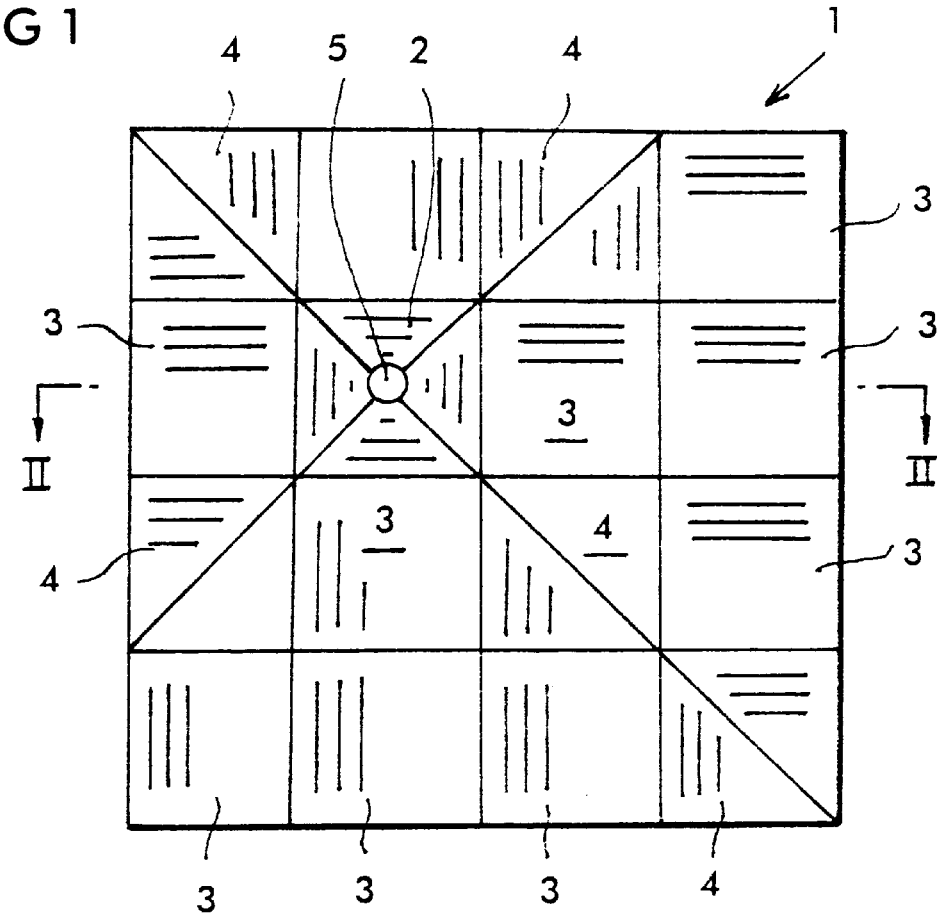
FIG. 1 shows a schematic plane view of a sanitary floor according to the present invention.
Figure 2:
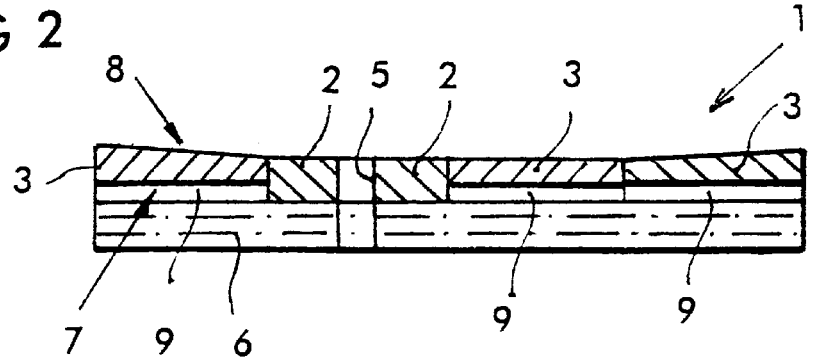
FIG. 2 shows a cross section along the line II—II in FIG. 1.

As can be seen from the drawings an embodiment of the invention refers to a sanitary floor 1, such as a floor to a bathroom, laundry or the like, said sanitary floor comprises a number of separate, prefabricated block elements 2, 3 and 4. These elements are, in the example illustrated, of a square formation. One of the block elements 2 comprises a floor drain 5, towards which the upper surface of this element inclines in a predetermined angle from the respective outer edge. The block elements 2–4 are supported by a bedding 6 against which their lower surface 7 contacts and extends parallelly. The upper surface 8 of the block elements 2–4 is, to the contrary, inclined a predetermined angle or inclines towards the floor drain 5 included in one or some of the elements.

In the example illustrated the floor 1 comprises of five corner block elements 4, each of which is provided with two inclinations which are inclined towards each other along a diagonal over the element in question. The floor 1 further comprises twelve block elements 3 which only are provided with an inclination towards one and the same direction and finally the block element 2 provided with the floor drain 5 itself which has four surfaces which incline or are inclined towards the floor drain 5.

Spacers 9 are used in order to have the outermost mounted block elements situated in level with and form smooth passages to adjacent block elements. This arrangement can be of an advantage in the cases of larger floor surfaces, where a bigger number of block elements are required. The area of the spacers 9 corresponds mainly to the block elements.

Figure 3:
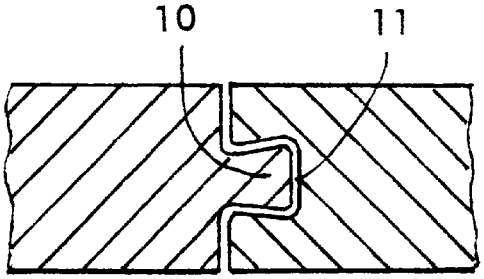
FIG. 3 shows an embodiment of the groove and tenon feature of the invention.

Referring now to FIG. 3, the block elements 2–4 can also be provided with groove 10 and temon 11 in their edge sections in order to achieve smoothness and in one and the same level lying passages between the different block elements 2–4, this which can be especially suitable if, for example, a plastic carpet shall be mounted on the floor formed by the block elements.

What is claimed is:

1. An arrangement for a sanitary floor comprising:

at least two separate adjacent block elements, at least one of the block elements includes a floor drain thereby forming a drain block element;

each block element having a lower surface which is parallel with a bedding supporting the block elements; and each block element further having an upper surface which inclines or is inclined towards the floor drain.

2. An arrangement according to claim 1, wherein the floor formed by the block elements comprises:

the drain block element;

at least two corner block elements, each of said corner block elements having two falls, which are inclined towards each other; and wherein all other block elements are provided with one fall towards the same direction.

3. An arrangement according to claim 1, further comprising lower elements, in the form of spacers, having substantially the same bottom area as the block elements, the lower elements are mountable under a respective block element thereby obtaining smooth passages between adjacent block elements.

4. An arrangement according to claim 1, wherein each block element is formed with a groove and a tenon at least at adjacent edge sections of the block elements.

5. An arrangement for a sanitary floor comprising:

at least two separate, adjacent block elements, at least one of the block elements includes a floor drain thereby forming a drain block element;

each block element having a lower surface which is parallel with a bedding supporting the block elements;

each block element further having an upper surface which inclines or is inclined towards the floor drain; and each block element is formed with a groove and a tenon at least at adjacent edge sections of the block elements.

6. An arrangement for a sanitary floor, said arrangement comprising:

a drain block including a drain disposed therein, said drain block having an upper surface which is inclined toward said drain; and at least one additional block disposed adjacent to said drain block, said additional block having an upper surface which is inclined toward said drain.

7. The arrangement as claimed in claim 6, wherein said upper surface of said drain block has four parts which are all inclined toward said drain.

8. The arrangement as claimed in claim 6, wherein said blocks are coupled together using a groove and tenon.

9. The arrangement as claimed in claim 6, further comprising at least one corner block having an upper surface with two inclinations inclined toward each other.

10. The arrangement as claimed in claim 6, wherein each of said additional blocks have upper surfaces which are inclined in the same direction.

11. The arrangement as claimed in claim 9, wherein each of said additional blocks have upper surfaces which are inclined in the same direction.

12. The arrangement as claimed in claim 11, wherein said upper surface of said drain block has four parts which are all inclined toward said drain.

13. The arrangement as claimed in claim 6, wherein all of said blocks have a lower surface which is parallel to a bedding, said bedding supporting said blocks.

14. The arrangement as claimed in claim 6, further comprising lower elements, in the form of spacers, having substantially the same bottom area as the block elements, said lower elements being mountable under a respective block element thereby obtaining smooth passages between adjacent block elements.

* * * * *